US005782368A

United States Patent [19]

Roberge

[11] Patent Number: 5,782,368

[45] Date of Patent: Jul. 21, 1998

[54] RACK FOR RECEIVING OBJECTS DELIVERING LIQUIDS AND DIRTS

[76] Inventor: Gaétan Roberge, 57 Des Pinsons, St-Basile Le Grand, Qc, Canada, J3N 1L1

[21] Appl. No.: 727,702

[22] Filed: Oct. 4, 1996

[51] Int. Cl.[6] ..... A47B 43/00

[52] U.S. Cl. ..... 211/194; 108/24; 108/91

[58] Field of Search ..... 211/194, 188, 211/36, 41.3, 41.4, 127.1, 133.3; 108/24

[56] References Cited

U.S. PATENT DOCUMENTS

| | | | |
|---|---|---|---|
| 2,632,568 | 3/1953 | Abt | 211/41.3 |
| 3,339,752 | 9/1967 | Trogan | 211/194 |
| 3,587,864 | 6/1971 | Delisle | 211/37 |
| 4,688,681 | 8/1987 | Bergeron | 211/36 |
| 5,141,117 | 8/1992 | Olsen et al. | 211/194 X |
| 5,172,816 | 12/1992 | Kline et al. | 211/194 X |
| 5,211,292 | 5/1993 | Paolucci | 211/194 X |
| 5,415,297 | 5/1995 | Klein et al. | 211/194 X |
| 5,562,047 | 10/1996 | Forney et al. | 108/24 X |

*Primary Examiner*—José V. Chen
*Attorney, Agent, or Firm*—Antoine H. Gauvin

[57] ABSTRACT

A rack for receiving objects delivering liquids and dirts, comprising at least one stackable module having a T-shaped cross-section. The module has walls defining a vertical passage, a tray outwardly projected from these walls making the vertical passage. The tray is horizontal, has an inclined bottom, and a perforated plate for receiving objects delivering liquids and dirts, supported by the tray, over the inclined bottom of that tray. A way to exit liquids and dirts is provided from the inclined bottom of the tray, towards and within the walls defining the vertical passage. The walls defining the vertical passage terminate at opposite ends into coupling for coupling with another similar module: for instance a male-female coupling. Thereby the modules are stackable for making a rack and are held by the walls defining the vertical passage. Preferably the rack has a support module having also walls defining a vertical passage.

14 Claims, 6 Drawing Sheets

(SECT. A–A)

(SECT. B-B)

RACK FOR RECEIVING OBJECTS DELIVERING LIQUIDS AND DIRTS

BACKGROUND OF THE INVENTION

1. Field of the Invention

This invention relates to a rack for receiving objects delivering liquids and dirts: that is liquids and/or dirts.

This invention relates in particular to such a rack to be used for wet overshoes and the like, and for growing plants, and being particularly useful as overshoe racks for boots, shoes, rubbers, overshoes, flower pots and other containers for gardening and the like.

2. Description of Related Art

U.S. Pat. No. 3,587,864 dated Jun. 28, 1971 as invented by Henri Deslisle, describes a boot rack for dripping overshoes, boots and the like, which is a housing having a boot receiving base panel, and an inclined overshoe receiving panel extending above the base panel and fixed to the opposite sidewalls of the housing.

BRIEF SUMMARY OF THE INVENTION

The aim of this invention is to have a light rack for receiving objects containing liquids and/or dirts, and particularly such racks:

that are modular, quickly stackable at will, having the least structure to ensure lightness in weight of the racks and to allow sun immersion if desired, and yet ensuring that no liquid and/or dirt from objects delivering liquids and/or dirts on the rack of one module, will fall onto and over the objects delivering liquids and/or dirts on the rack of a lower module; these objects delivering liquids and/or dirts, wether boots, shoes, rubbers, overshoes, flower pots and other containers for gardening and the like are placed on trays of the racks being substantially horizontal.

Broadly stated the invention is directed to a rack for receiving objects delivering liquids and dirts: that is liquids and/or dirts, comprising:

at least one stackable module having a substantially T-shaped cross-section, said stackable module having:

walls defining at least one substantially vertical passage, said at least one vertical passage, having opposite ends, a tray outwardly projected from said walls, said tray having an inclined bottom, and being substantially horizontal, and a perforated plate for receiving objects delivering liquids and dirts, supported by said tray, over said inclined bottom of said tray, a way to exit said liquids with dirts from said inclined bottom of said tray, towards said walls defining at least one substantially vertical passage, and within said at least one vertical passage, said tray with said at least one vertical passage defining said substantially T-shaped cross-section of a module, and said walls defining said at least one vertical passage defining a coupling at at least one of said opposite ends of said vertical passage, for said at least one of said opposite ends of said vertical passage, to enter into another similar vertical passage of another module, at said other of said opposite ends of said vertical passage of said other module, and thereby said modules being stackable.

In a preferred embodiment, the invention is directed to a rack for receiving objects delivering liquids and dirts, comprising:

at least one stackable module having a T-shaped cross-section, said stackable module having:

opposite front and rear ends, walls defining a substantially vertical passage, near said rear end, said vertical passage, having opposite ends, a tray outwardly projected from said walls, towards said front end, said tray having an inclined bottom, and being substantially horizontal, and a perforated plate, for receiving objects delivering liquids and dirts, supported by said tray, over said inclined bottom of said tray, a way to exit said liquids and dirts from said inclined bottom of said tray, towards said walls, and within said vertical passage, said tray with said at least one vertical passage defining said substantially T-shaped cross-section of a module, and said walls defining said vertical passage having coupling at said opposite ends, for one of said opposite ends to enter into another similar vertical passage of another module, at said other of said opposite ends of said vertical passage of said other module, for coupling two of said passage and of said walls, and thereby said walls defining said vertical passage of said stackable module being solely responsible for supporting said stakable trays, and for directing liquids and dirts from the trays of that stackable modules, to the vertical passage of the support module, to be sent to a means to collect said liquids and dirts.

In a preferred embodiment, the coupling at said opposite ends is a male end portion at one of said opposite ends, and a female portion at the other of said opposite ends.

Further embodiments of the invention will be described herein below.

DESCRIPTION OF THE DRAWINGS

In the drawings which illustrate some of the preferred ways of carrying out the invention.

DETAILED DESCRIPTION

Figure 1:
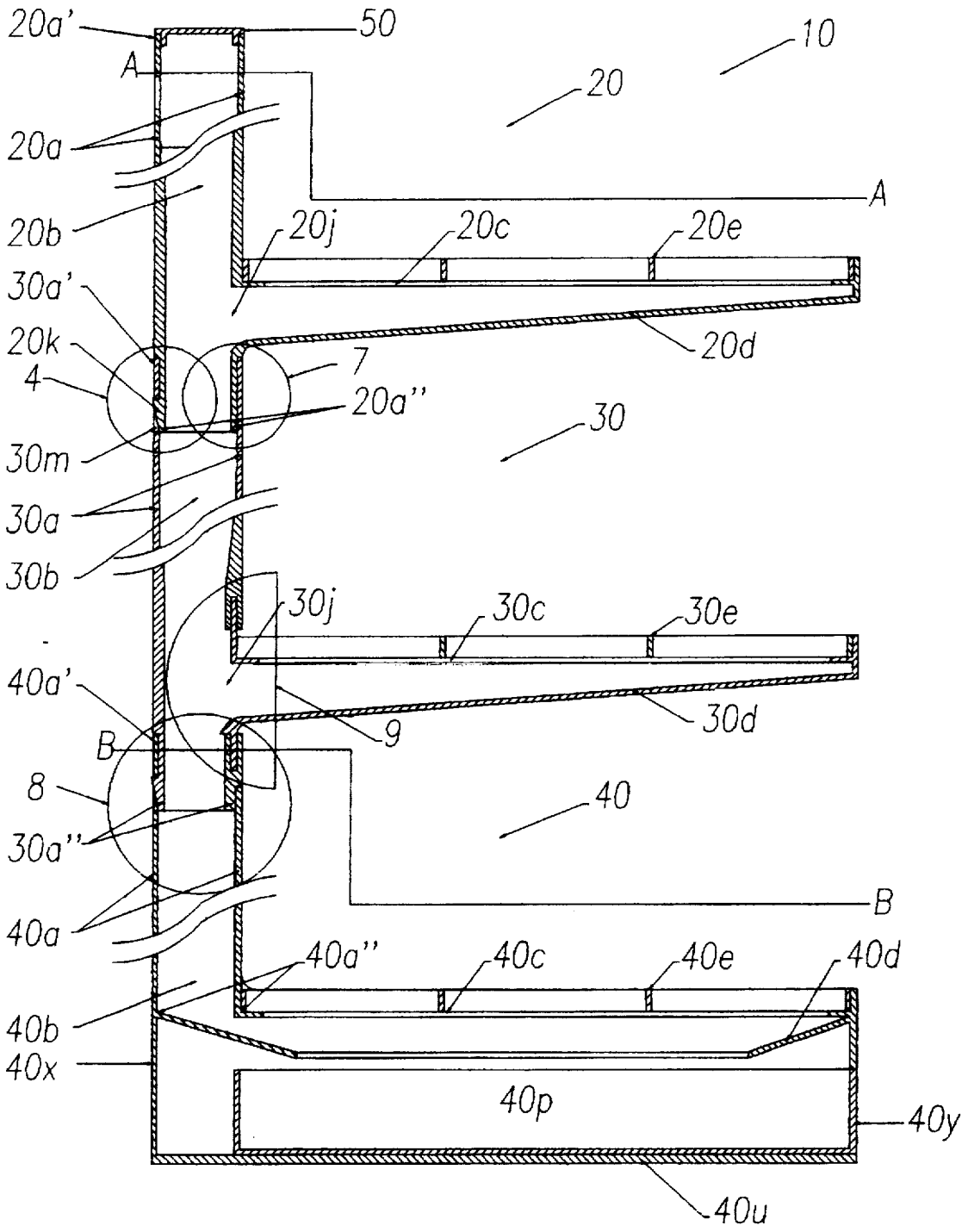
FIG. 1 is a side, cross-section view taken along line 1—1 of FIG. 2, of a rack for receiving objects delivering liquids and dirts.

As shown in FIG. 1, a rack 10 for receiving objects delivering liquids and dirts, comprises at least one stackable module such as 20, and 30, having a T-shaped cross-section. Objects that are delivering liquids and dirts are for instance boots, shoes, rubbers, overshoes, flower pots, and other containers for gardening and the like.

Figure 2:
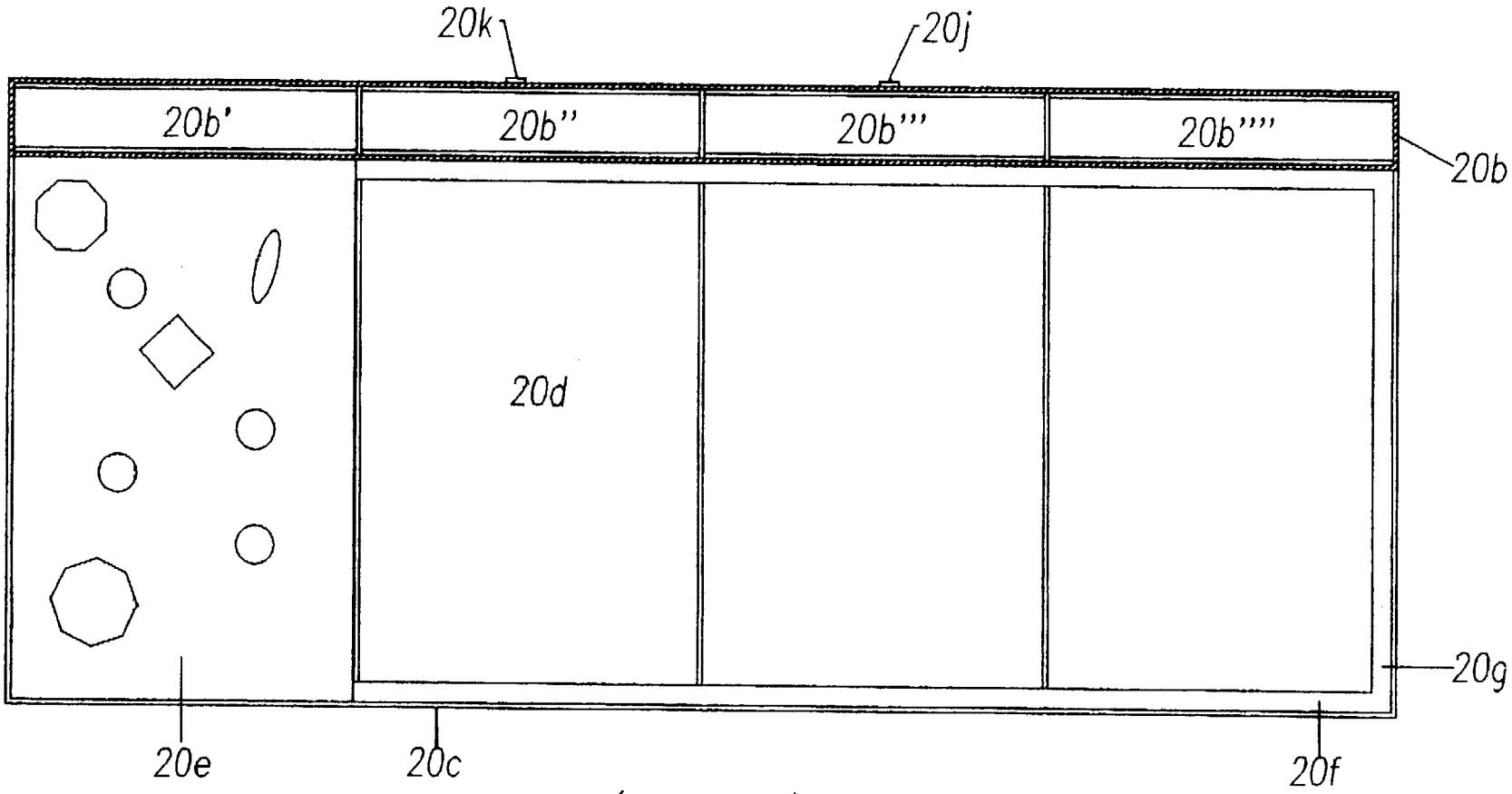
FIG. 2 of a scale smaller than in FIG. 1, is a top view taken along line A—A of FIG. 1, with only a portion of a perforated plate for receiving objects delivering liquids and dirts.

The stackable module such as 20 or 30, for instance 20, has:

walls, for instance 20a or 30a, as shown in FIGS. 1 and 2, two longitudinal walls spaced one from the other and facing one another, and bridging lateral walls across said two longitudinal walls whereby said longitudinal walls cooperate with said lateral walls to define at least one substantially vertical passage, for instance 20b or 30b. The walls defining at least one vertical passage, have opposite ends, for instance 20a' and 20a", or 30a' and 30a".

A tray, 20c or 30c, is outwardly projected from one of said two longitudinal walls 20a or 30a, between said opposite ends of said walls defining at least one vertical passage.

the tray has an inclined bottom 20d or 30d.

Figure 3:
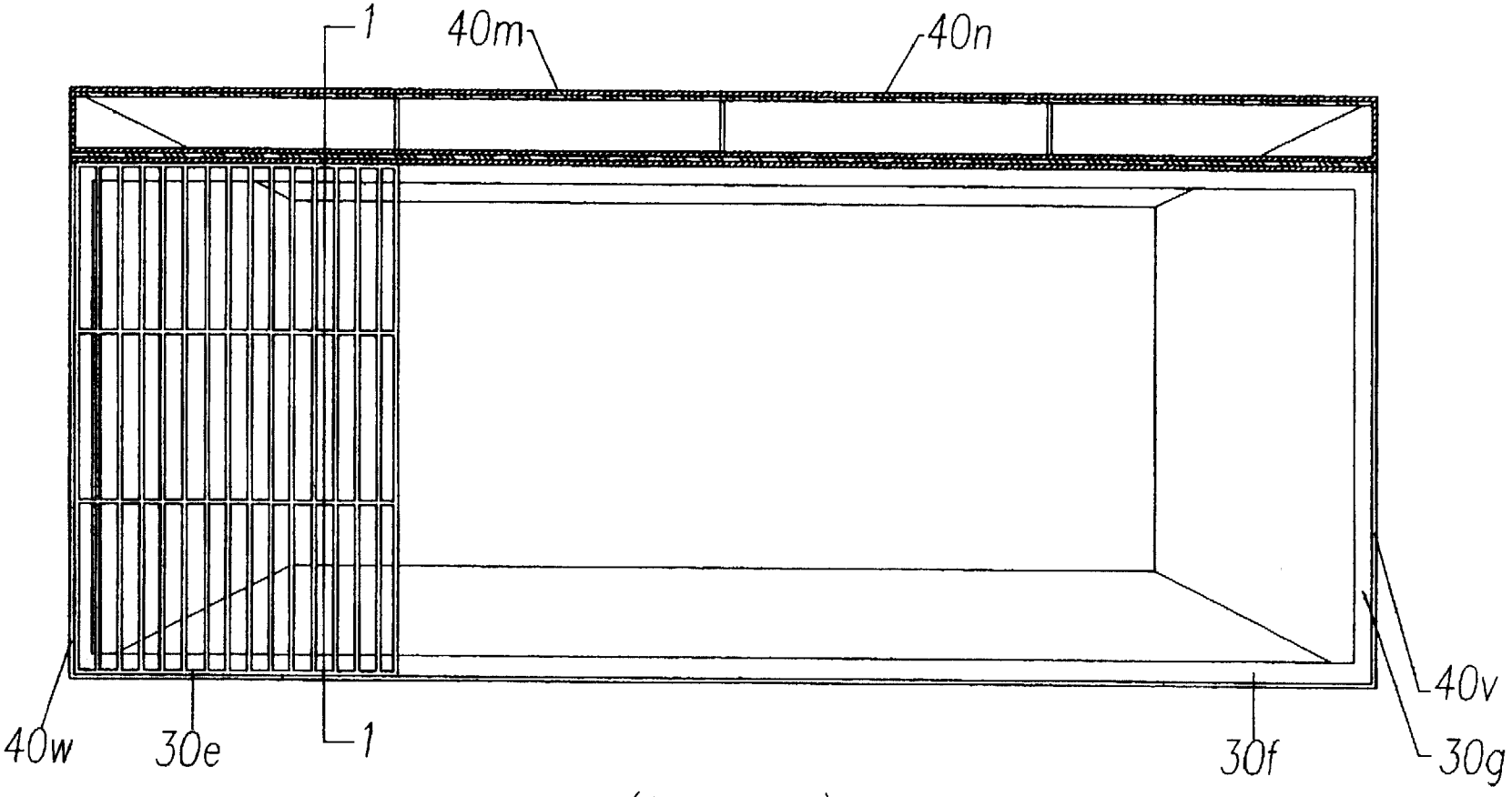
FIG. 3 of a scale similar to FIG. 2, is a top view taken along line B—B of FIG. 1 with only a portion of a perforated plate for receiving objects delivering liquids and dirts.
Figure 6:
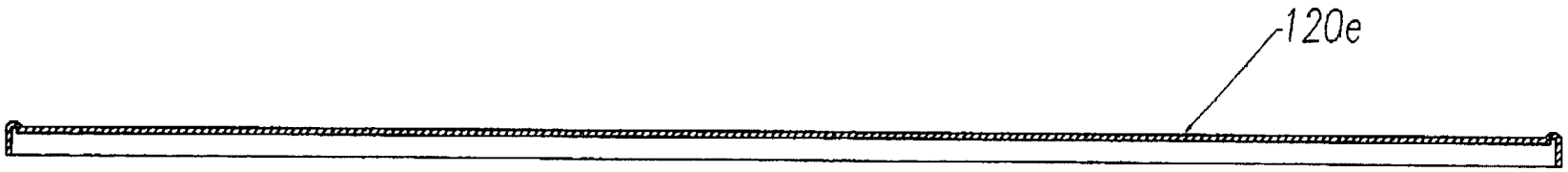
FIG. 6 of a scale similar to FIG. 2, is a cross-section view, of another perforated plate.

A perforated plate 20e or 30e which is substantially horizontal, that is somewhat horizontal, for receiving objects delivering liquids and dirts, is supported by the tray, wether mounted within or above the tray 20c and preferably removably mounted, but over the inclined bottom 20d of the tray 20c. Mounting may be made in numerous ways: For instance, by providing outwardly projected ribs within the upper portion of the trays, as shown at 20f and 20g, FIG. 2. The perforated plate may be a grid as shown at 30e, FIG. 3 or have various perforations, some of which being illustrated in plate 20e, FIG. 2. The plate may simply have a U-shaped cross-section, as shown at 120e, FIG. 6, and thereby avoiding ribs for the mounting, the free ends of the inverted U-shaped plate resting against the outer sides of the tray. The perforated plate may be a single plate or a plate segmented into a plurality of plates, and thus the word plate in the expression: "perforated plate" implies singular as well as plural throughout the specification including the claims.

A way is provided to exit liquids and dirts from the inclined bottom of the tray, through the walls defining the vertical passage, and within the at least one vertical passage: Conveniently one of the longitudinal walls of the walls 20a, defining the substantially vertical passage 20b, is absent, cut out, perforated, such as at 20j or provided with a drain, to open in the tray 20c, and particularly adjacent to the inclined bottom 20d of the tray 20c, and similarly 30j for tray 30c.

The tray with the at least one vertical passage, defines the substantially T-shaped cross-section of a module.

The walls such as 20a defining the at least one vertical passage, defines a coupling at at least one of the opposite ends of the vertical passage, for said at least one of the opposite ends of the vertical passage, to enable coupling with another similar vertical passage of another module, and thereby the modules being stackable:

For instance, one coupling is by outwardly reducing the walls defining the vertical passage, at one of the opposite ends, as shown at 20a", or 30a", for entering into another similar vertical passage of another module, at said other of the opposite ends of the vertical passage of said another module, as shown at 30a' or 40a', for coupling two of the vertical passages and the walls defining those passages, and thereby the modules such as 20 and 30 being stackable, with a male-female coupling.

Thus, the walls defining said vertical passage of a stackable module are solely responsible for supporting the trays, and for directing liquids and dirts away from the trays of the stackable modules to the vertical passage of another module, these modules being stackable.

Figure 4:
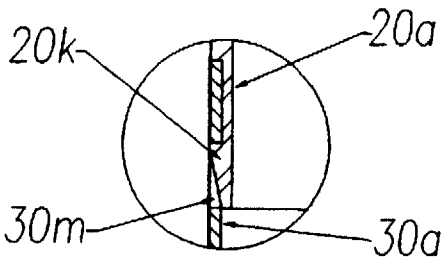
FIG. 4 is an enlarged circular section view, taken from the circular portion 4 of FIG. 1.

In a preferred embodiment, the vertical passage and the walls defining them are tightly fit as to be releasably held by friction engagement. However, in another preferred embodiment, as shown in FIGS. 1 and 4, the opposite ends of the vertical passage are provided with means to releasably hold said vertical passage of one of said stackable module to a vertical passage of another stackable module, for temporary coupling, or relessably holding the vertical passage of two of said stackable modules: For instance, the walls or one of the walls being reduced or tapered at one of the opposite ends are provided with at least one outwardly biassing tongue, such as 20k, and 20l (FIG. 2), and at the other opposite end, said walls are provided with a complementary slot such as 30m for 20k, or as shown at 40m, 40n (FIG. 3), for receiving an outwardly biassing tongue, of another stackable module, and thereby temporary coupling two stackable modules upon a mere snap-on action of the vertical passage of two of said stackable modules.

Figure 5:
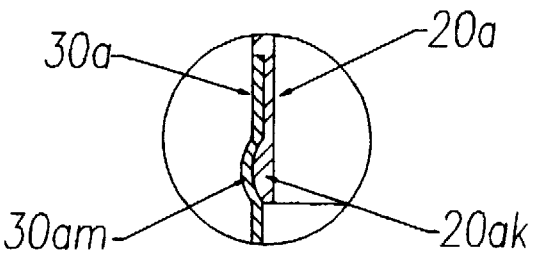
FIG. 5 is a view similar to that of FIG. 4, but illustrating another coupling for the opposite ends of the wall portions defining vertical passages.

Still instead, as shown in FIG. 5 the walls such as 20a, or 30a defining a male-female coupling at one of the opposite ends is provided with an outwardly projected boss or mating projection 20ak, and at the other opposite end, said walls are provided with a complementary hole or depression 30am, for receiving an outwardly projected boss, of another stackable module, and thereby temporary coupling two stackable modules upon a mere snap-on action of the vertical passage of two of said stackable modules.

In this way, these racks may be made by extrusion with a minimum amount of plastic material, since sides are not required to support the trays. Examples of plastic materials but not limited thereto include polyethylene, polyvinylchloride, ABS, and other plastic extrudable materials. Thus the tray of the stackable module are made to be integral with the walls defining a substantially vertical passage. Furthermore, these racks enable sun or light radiation without interference along 3 sides: for instance the two opposite sides and the front. Furthermore the liquids and dirts from one module, are prevented from falling over the perforated plate of a lower module there under, and on objects delivering liquids and dirts standing on said plate.

Preferably, the walls defining the vertical passage have the one end short and the other end long, so that the weight of the tray and its content are supported by the short end only or the walls defining the vertical passage of the tray and the walls defining the vertical passages of other trays thereunder as the case may be.

Figure 7C:
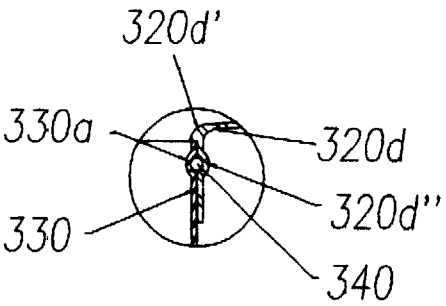
FIG. 7c is a view similar to that of FIG. 7a, but illustrating another coupling for the opposite ends of the wall portions defining vertical passages.
Figure 7B:
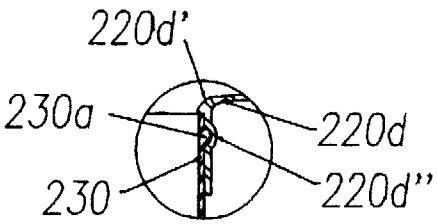
FIG. 7*b* is a view similar to that of FIG. 7*a*, but illustrating another coupling for the opposite ends of the wall portions defining vertical passages.
Figure 7A:
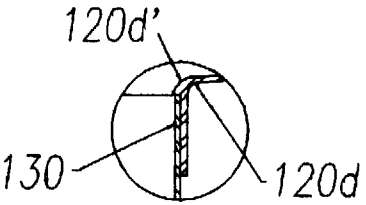
FIG. 7*a* is an enlarged circular section view, taken from the circular portion 7 of FIG. 1.

In another embodiment, as shown in FIG. 7a, the walls at one of the opposite ends, such as the free end of the inclined bottom 20d of tray 20 (FIG. 1), define an outwardly broadening sleeve 120d, that sleeve to slide over and to tightly fit over, an other end of the walls defining at least one substantial vertical passage on another module such as 130 similar to 30, for temporary coupling two vertical passages of two modules upon a mere snap-on action of the vertical passages. That sleeve 120*d* is also provided with a lip 120*d'* running over the end of the walls 130, in order to prevent water leakage between the walls 130 and the sleeve 120*d*.

That sleeve such as 220*d* as shown in FIG. 7*b*, may be provided with a rib 230*a* at the end of the walls 230 otherwise similar to 130, and a correspondingly groove arrangement 220*d''* in the sleeve 220*d* otherwise similar to 120*d*, with lip 220*d'*.

That sleeve such as 320*d* as shown in FIG. 7*c*, may be provided with a sealing O-ring 340 for liquid tight arrangement, with a groove 330*a* near the end of the walls 330 otherwise similar to 130, and a correspondingly groove arrangement 320*d''* in the sleeve 320*d* otherwise similar to 120*d*, with lip 320'.

Support Module

Preferably the stackable module or modules end into a support module for example 40 having walls 40*a* defining at least one vertical passage 40*b*. The vertical passage has one end for example 40*a'* for receiving one of the opposite ends of the vertical passage of the at least one stackable module, and means to collect said liquids and dirts from said vertical passage of said support module:

The means to collect the liquids and dirts from the vertical passage of the support module, may simply be a pan 40.

Figure 8:
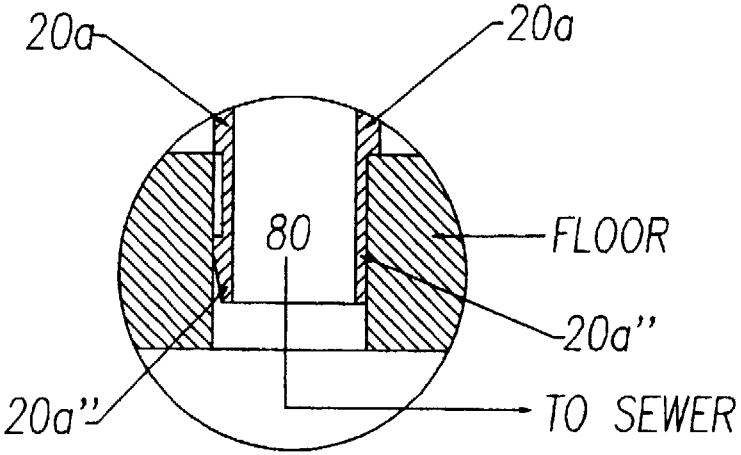
FIG. 8 is an enlarged circular section view, taken from the circular portion 8 of FIG. 1, illustrating another means to support the stackable modules.

The means to collect the liquids and dirts from the vertical passage of the support module, may simply be a perforated floor 80 leading to a sewer, as shown in FIG. 8.

Preferably, the support module has:

opposite front and rear ends, two longitudinal walls adjacent to said rear end, spaced one from the other and facing one another, and bridging lateral walls across, whereby said, walls such as 40*a* defining a substantially vertical passage such as 40*b*, near said rear end, said walls having upper and lower ends, said vertical passage, having opposite ends, such as 40*a'* and 40*a''*, a tray 40*c* outwardly projected from said walls 40*a*, towards said front end, between the opposite ends of the longitudinal wall, said tray having a bottom 40*d*, and legs 40*x* and 40*y* for seating said support module 40, and a perforated plate 40*e*, for receiving objects delivering liquids and dirts, supported by said tray, over said bottom of said tray, said plate being substantially horizontal, a way to exit said liquids and dirts from said vertical passage and from said tray of said support module, towards a collecting means, and said walls defining said vertical passage such as 40*a'*, being defined to receive the walls of one of the opposite ends of the vertical passage of a stackable module, such as 20*a''* or 30*a''*, for coupling the vertical passage of said support module 40 to that of a stackable module, such as 20 or 30, and thereby the walls defining the vertical passages being solely responsible for supporting the trays, and for directing liquids and dirts from the trays of that stackable modules, to the vertical passage of the support module, to be sent to a means to collect said liquids and dirts.

In a particular embodiment the tray 40*d* extends under the vertical passage such as 40*b*, and is integral with the walls of the vertical passage of the support module, and the bottom of the tray, such as 40*d* which is arched (FIG. 1) is perforated acting as a funnel, in order to deliver the liquids and dirts to a collecting pan to be positioned thereunder, or the tray may be bottomless and the liquids and dirts be running directly into the pan. The tray having integral therewith the leg 40*y*. If desired the support module may be provided with a base 40*u* and/or sides such as 40*v*, and 40*w* joining the legs 40*x*, 40*y*. The sides such as 40*y* being integral with the base 40*u* and the legs 40*x* and 40*y*.

If desired, the uppermost portion of the walls defining the vertical passage may be provided with a cap 50.

As can be easily seen, the walls defining at least one substantially vertical passage, may be closed at one end, for instance instead of a cap 50, a tray may be provided with a top wall integral with the walls such as 30*a'*.

Also as shown in FIG. 2, instead of a single vertical passage, a plurality of vertical passages such as 20*b'*, 20*b''*, 20*b'''*, 20*b''''*, (FIG. 2), may be provided.

The tray may also be provided with ribs, or walls which may also act to support the perforated plate.

Figure 9:
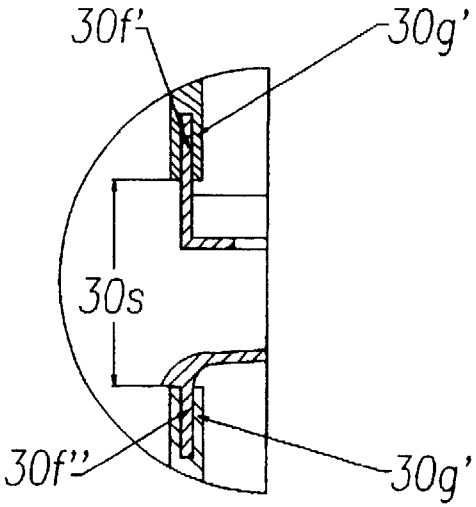
FIG. 9 is an enlarged circular section view, taken from the circular portion 9 of FIG. 1, illustrating a means of releasably holding the tray to the walls defining at least one substantially vertical passage.

The trays need not be integral with the walls defining the at least one vertical passage: For instance, as shown in FIGS. 1 and 9, these walls may define a slot such 30*s* with adjacent opposite grooves such as 30*g'* and 30*g''*, adjacent to the slot 30*s*, to receive a tray 30 having free ends 30*f'* and 30*f''*, via the free ends of the tray 30.

While some of the preferred embodiments have been described herein above, it is to be understood that the invention is not to be construed as limited to these preferred embodiments, as many modifications and variations are possible within the spirit and scope of the appended claims.

I claim:

1. A rack for receiving objects delivering liquids and dirts, comprising:

a stackable module, said stackable module having:

two longitudinal walls, said two longitudinal walls being spaced one from the other and facing one another, and bridging lateral walls across said two longitudinal walls whereby said longitudinal walls cooperate with said lateral walls to define at least one substantially vertical passage, said longitudinal and said lateral walls defining at least one vertical passage, having opposite ends, a tray outwardly projected from one of said two longitudinal walls, between said opposite ends of said walls defining at least one vertical passage, said tray having an inclined bottom, for said bottom to direct liquids and dirts towards said one of said two longitudinal walls, and a perforated plate for receiving objects delivering liquids and dirts, supported by said tray, over said inclined bottom of said tray, said perforated plate being substantially horizontal, a way to exit said liquids with dirts from said inclined bottom of said tray adjacent to said one of said two longitudinal walls defining at least one substantially vertical passage, through said one of said two longitudinal walls, and between said opposite ends of said walls, and into said at least one vertical passage, for said liquids and dirts to be displaced from said tray through said one of said two longitudinal walls and to fall through said at least one vertical passage, said stackable module having a substantially T-shaped cross-section, said T-shaped cross-section having a top, a bottom and a central portion running from said top to said bottom;

said bridging lateral walls with said two longitudinal walls thus defining the top of said substantially T-shaped cross-section of said stackable module.

and said tray with said perforated plate defining the central portion running from the bottom to the top of said substantially T-shaped cross-section of said stackable module.

and said walls defining at least one vertical passage, defining a coupling, at at least one of said opposite ends, for said walls defining at least one vertical passage, to enable bridging at said coupling with another module having substantially similar walls defining at least one vertical passage, at said other of said opposite ends of said walls defining at least one vertical passage of said other module, and thereby said modules being stackable via said longitudinal and said lateral walls defining at least one vertical passage, having opposite ends.

2. The rack for receiving objects delivering liquids and dirts as defined in claim 1, wherein said walls at one of the opposite ends define an outwardly broadening sleeve, said sleeve to slide over and to tightly fit over, an other end of the walls defining at least one substantial vertical passage on another module for temporary coupling said at least one vertical passage of two modules upon a mere snap-on action of the vertical passages.

3. The rack for receiving objects delivering liquids and dirts as defined in claim 2, wherein said sleeve includes a lip to fit over said other end of the walls defining at least one substantial vertical passage on another module.

4. The rack for receiving objects delivering liquids and dirts as defined in claim 1, wherein said perforated plate.

5. A rack for receiving objects delivering liquids and dirts, comprising:

a stackable module, said stackable module having:

opposite front and rear ends, two longitudinal walls, said two longitudinal walls being spaced one from the other and facing one another, and bridging lateral walls across said two longitudinal walls whereby said longitudinal walls cooperate with said lateral walls to define at least one substantially vertical passage, near said rear end, said longitudinal and said lateral walls defining at least one vertical passage, having opposite upper and lower ends, a tray outwardly projected from one of said two longitudinal walls, between said opposite ends of said walls defining at least one vertical passage, towards said front end, said tray having an inclined bottom, for said bottom to direct liquids and dirts towards said one of said two longitudinal walls, and a perforated plate, for receiving objects delivering liquids and dirts, supported by said tray, over said inclined bottom of said tray, said perforated plate being substantially horizontal, a way to exit said liquids and dirts from said inclined bottom of said tray adjacent to said one of said two longitudinal walls defining at least one substantially vertical passage, through said one of said two longitudinal walls, and between said opposite ends of said walls, and into said at least one vertical passage, for said liquids and dirts to be displaced from said tray through said one of said two longitudinal walls and to fall through said at least one vertical passage, said stackable module having a substantially T-shaped cross-section, said T-shaped cross-section having a top, a bottom and a central portion running from said top to said bottom;

said bridging lateral walls with said two longitudinal walls thus defining the top of said substantially T-shaped cross-section of said stackable module, and said tray with said perforated plate defining the central portion running from the bottom to the top of said substantially T-shaped cross-section of said stackable module, and said walls defining at least one vertical passage, defining a male of a male-female coupling, at one of the opposite ends, and a female for said male-female coupling at the other of the opposite ends, for coupling with another module having similar walls defining at least one vertical passage and similar male-female coupling, at said other of said opposite ends of said vertical passage of said other module having said female of said male-female coupling, for coupling two of said modules, and thereby said walls defining said at least one vertical passage of said stackable module being solely responsible for supporting said tray, and for directing, between said walls liquids and dirts away from the tray of that stackable module, said module being stackable.

6. The rack for receiving objects delivering liquids and dirts as defined in claim 5, wherein said tray of said stackable module is integral with said one of said two longitudinal walls.

7. The rack for receiving objects delivering liquids and dirts as defined in claim 5, wherein said opposite ends of said walls defining at least one vertical passage include means to releasably hold said walls of said stackable module to said another stackable module having similar walls and similar male-female coupling, for temporary coupling said at least one vertical passage of two of said stackable modules.

8. The rack for receiving objects delivering liquids and dirts as defined in claim 5, wherein said walls at said one of the opposite ends are provided with an outwardly biassing tongue, and at the other opposite end, said walls are provided with a complementary slot for receiving an outwardly biassing tongue, of another stackable module, and thereby temporary releasably holding the coupling of two stackable modules upon a mere snap-on action of the vertical passage of two of said stackable modules.

9. The rack for receiving objects delivering liquids and dirts as defined in claim 5, wherein said walls at one of the opposite ends are provided with an outwardly projected boss, and at the other opposite end, said walls are provided with a complementary hole for receiving an outwardly projected boss, of another stackable module, and thereby temporary coupling two stackable modules upon a mere snap-on action of the vertical passage of two of said stackable modules.

10. The rack for receiving objects delivering liquids and dirts as defined in claim 5, wherein said stackable module includes a support module, said support module having:

two longitudinal walls, said two longitudinal walls being spaced one from the other and facing one another, and bridging lateral walls across said two longitudinal walls whereby said longitudinal walls cooperate with said lateral walls to define at least one substantially vertical passage, said longitudinal and said lateral walls of said support module defining at least one vertical passage, having opposite ends, said opposite ends being respectively an upper and a lower end, at one of said opposite ends, said longitudinal and said lateral walls of said support module defining a male-female coupling for engaging said male-female coupling of said stackable module, for coupling one of said opposite ends of said at least one vertical passage of said stackable module, with one of said ends of said at least one vertical passage of said support module, and means to collect said liquids and dirts from said vertical passage of said support module, and thereby said walls defining said at least one vertical passage being responsible for directing, between said walls, said liquids and dirts toward said means to collect said liquids and dirts.

11. The rack for receiving objects delivering liquids and dirts as defined in claim 10, wherein said means to collect said liquids and dirts from said vertical passage of said support module, is a pan.

12. The rack for receiving objects delivering liquids and dirts as defined in claim 10, wherein said means to collect said liquids and dirts from said vertical passage of said support module, is a pipe leading to a sewer.

13. The rack for receiving objects delivering liquids and dirts as defined in claim 5, which includes a support module, said support module having:

opposite front and rear ends, two longitudinal walls adjacent to said rear end, said two longitudinal walls being spaced one from the other and facing one another, and bridging lateral walls across said two longitudinal walls whereby said longitudinal walls cooperate with said lateral walls to define at least one substantially vertical passage, near said rear end, said longitudinal and said lateral walls of said support module defining at least one vertical passage, said longitudinal and said lateral walls having respectively opposite upper and lower ends, a tray outwardly projected from one of said longitudinal walls, towards said front end, between said opposite ends of said one of said longitudinal walls, said tray having a bottom, and legs for seating said support module, and a perforated plate, for receiving objects delivering liquids and dirts, supported by said tray, over said bottom of said tray, said perforated plate being substantially horizontal, a way to exit said liquids and dirts from said vertical passage and from said tray of said support module, towards a collecting means, at said upper end of said walls defining at least one vertical passage, said longitudinal and said lateral walls of said support module defining a male-female coupling for engaging said male-female coupling of said stackable module, for coupling with the walls of the lower end of said vertical passage of said stackable module, for coupling the vertical passage of said support module to that of said stackable module, and thereby said walls defining said vertical passage of said stackable module being solely responsible for supporting said tray of said stakable module, and for directing liquids and dirts from the trays of said stackable module, to the vertical passage of the support module, to be sent to a means to collect said liquids and dirts.

14. The rack for receiving objects delivering liquids and dirts as defined in claim 13, wherein said bottom of said tray of said support module is arched, and extends to the other of said two longitudinal wall as to close said walls, and said bottom of said tray has a central perforated portion, said means to collect said liquids and dirts, is a pan to be positioned under said perforated portion of the tray of the support module, thereby said liquids and said dirts on leaving said at least one vertical passage are displaced over the arched portion to the central perforated portion of the tray and then to the pan.

* * * * *